US012091924B2

(12) United States Patent
Vissotski et al.

(10) Patent No.: US 12,091,924 B2
(45) Date of Patent: Sep. 17, 2024

(54) QUICK RELEASE SLIPS, METHOD, AND SYSTEM

(71) Applicant: Baker Hughes Oilfield Operations LLC, Houston, TX (US)

(72) Inventors: Andrew John Vissotski, Spring, TX (US); Nicholas S. Conner, Cypress, TX (US); Robert Schramm, League City, TX (US); Jose Eduardo Barragan, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/976,412

(22) Filed: Oct. 28, 2022

(65) Prior Publication Data

US 2024/0141740 A1 May 2, 2024

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 33/129
See application file for complete search history.

(56) References Cited

U.S. PATENT DOCUMENTS

2015/0292283 A1* 10/2015 Lemm ..... E21B 33/1291 166/217
2017/0198543 A1* 7/2017 Nordheimer ..... E21B 34/14
2020/0300058 A1* 9/2020 Davison ..... E21B 33/1293

* cited by examiner

*Primary Examiner* — Kristyn A Hall
(74) *Attorney, Agent, or Firm* — CANTOR COLBURN LLP

(57) ABSTRACT

A slip includes a slip body made up of a slip tail, a slip mid-section, and a slip head. A wicker segment is receivable in a recess of the slip head, the segment having a first condition where the segment is immovable relative to the head and a second condition where the segment is movable relative to the head. A method for retrieving a tool having slips, includes loading the slip in tension, releasing a wicker segment of the slip, allowing the segment to move from a first condition to a second condition and disengaging the segment from a radially outward structure. A borehole system includes a borehole in a subsurface formation, a string in the borehole, and a slip having a releasable wicker segment disposed within or as a part of the string.

19 Claims, 5 Drawing Sheets

QUICK RELEASE SLIPS, METHOD, AND SYSTEM

BACKGROUND

In the resource recovery and fluid sequestration industries, anchors are used to secure various tools in place in a borehole. Anchors include slips that are driven into a tubular structure and loaded there, commonly by a cone, ramp or inclined plane. In some cases, anchors are intended to be permanent but in other cases anchors are intended to be temporary and retrievable. In these cases, the anchor must have a way of allowing the slips to collapse away from the tubular structure in which they are set. Generally, this is accomplished by imparting a tensile load to uphole slips to pull them to a portion of the cone, ramp or inclined plane that is of smaller outside diameter than that upon which the set slips would be supported. While the described method is ubiquitously used in the art, it often is accompanied by a tensile failure of the slips and potential for the anchor being stuck in position. Occurrences of this nature cause inefficiencies comprising lost time and additional runs to drill out the anchor. The art would well receive alternatives avoiding the downtime associated with slips having a tensile failure in retrieval.

SUMMARY

An embodiment of a slip including a slip body, the body including a slip tail, a slip mid-section connected to the tail, and a slip head connected to the mid-section, and a wicker segment receivable in a recess of the slip head, the segment having a first condition where the segment is immovable relative to the head and a second condition where the segment is movable relative to the head.

An embodiment of a slip having a releasable wicker segment.

An embodiment of an anchor tool including a mandrel, a cone, ramp or inclined plane on the mandrel, a slip in operable contact with the cone, ramp or inclined plane, the slip having a wicker segment that is releasable from the slip.

An embodiment of a method for retrieving a tool having slips, including loading the slip in tension, releasing a wicker segment of the slip, allowing the segment to move from a first condition to a second condition disengaging the segment from a radially outward structure.

An embodiment of a borehole system including a borehole in a subsurface formation, a string in the borehole, and a slip disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
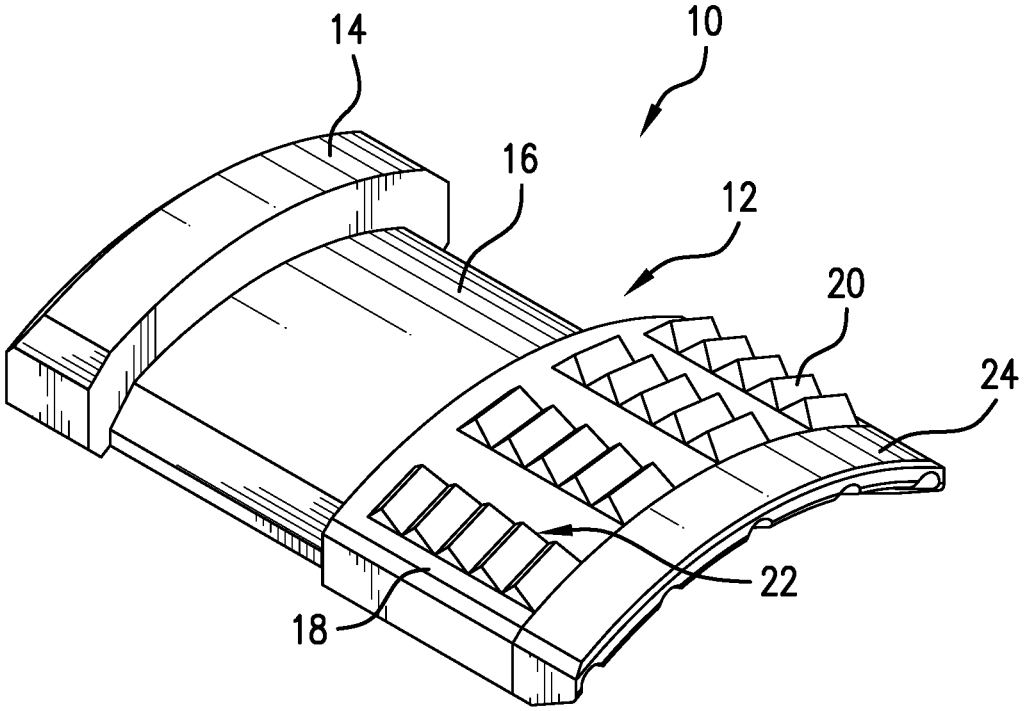
FIG. 1 is a prospective view of a quick release slip.
Figure 2:
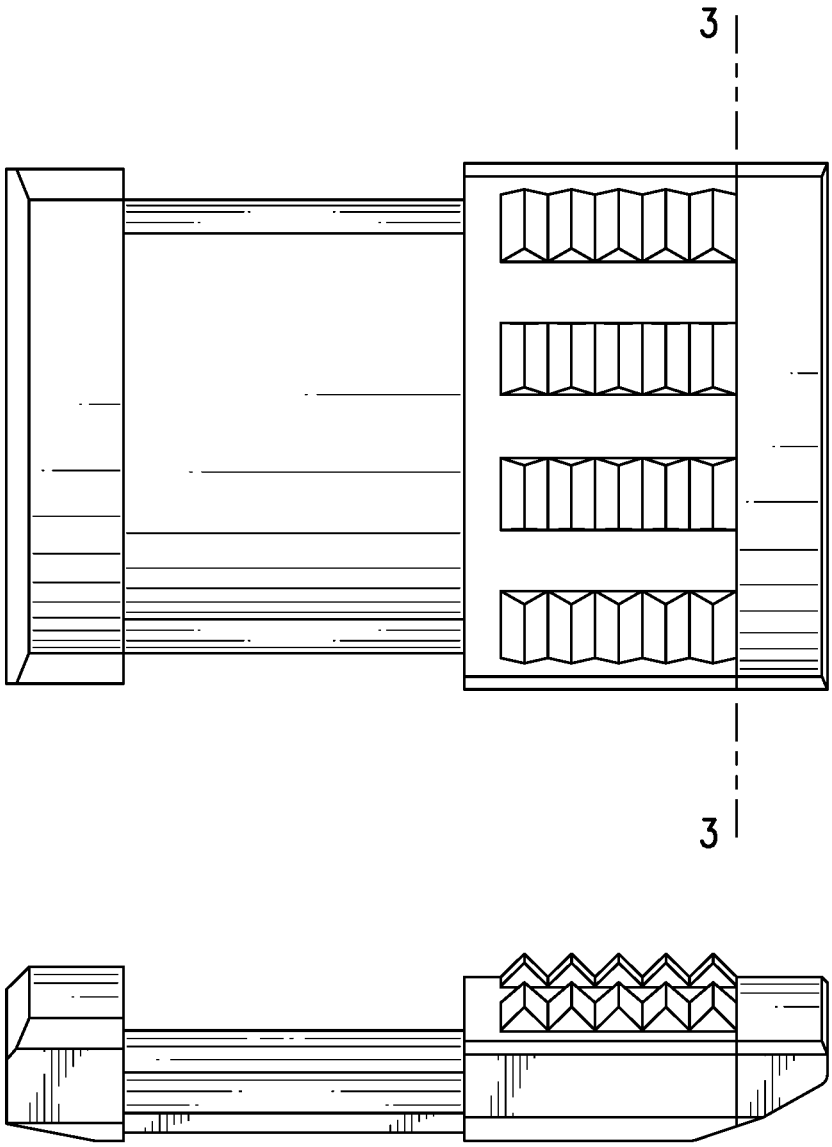
FIG. 2 is a planned view of the slip of FIG. 1.
Figure 3:
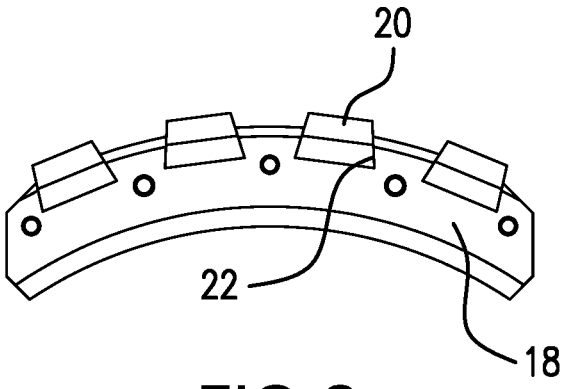
FIG. 3 is a cross-section view taken along section line 3-3 in FIG. 2.

Referring to FIGS. 1-3, a slip 10 having a body 12 comprising a slip tail 14, a slip mid-section 16 and a slip head 18 is illustrated. A wicker segment 20 is retained in a groove 22 in the head 18. In an embodiment, longitudinal retention of the segment 20 is by a cap 24. Cap 24 may be retained in place relative to the head 18 in a variety of ways including via fastener, a friction fit, etc. The segment 20 is contained in a first condition while the cap is retained in place near or in contact with the head 18 and is allowed to move in a second condition where the cap 24 is moved relative to the head 18. The cap 24 is configured to increase space between it and the head 18 during a retrieval operation where tension is applied to the slip 10 (which creates the second condition for the segment 20). In embodiments, the groove 22 may be a dovetail in order to retain the segment 20 radially.

Figure 4:
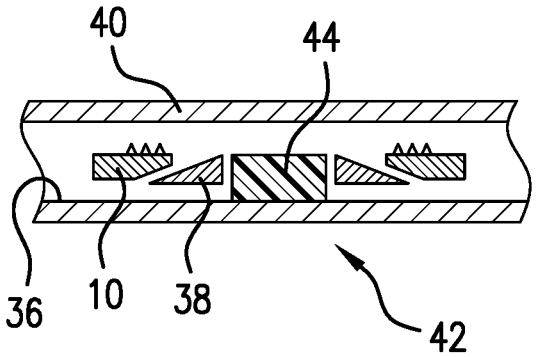
FIG. 4 is a quarter sectional view of an anchor tool employing the slip.

For orientation purposes, any slip including slip 10, during setting, would be driven along a mandrel 36 into a radially outwardly positioned structure, such as a casing 40, by being forced to climb a cone, ramp or inclined plane 38. This is well known to those in the art. Wickets of any slip and specifically the wicker segment 20 of the slip 10 (see FIG. 4) will bite into the casing 40 and make the anchor 42, of which the slip 10 is a part, secure in the casing 40. The particular anchor 42 illustrated also includes a seal element 44, but this is not required. During a retrieval operation, the same wickers whether in the slip 10 or a prior art slip will resist a tensile load placed on the slip 10. With slip 10, however, the tensile load on the wicker segment 20 will load the cap 24 until the cap 24 achieves a greater spacing from the head 18 (cap 24 is released from the head as discussed further below) allowing the segment 20 to move relative to the slip head 18. The ability of the segment 20 to move relative to the head 18 means that the slip 10 can begin to move off the cone, ramp or inclined plane 38 without the resistance of the wickets in the casing 40. By the time the segment 20 would be loaded in tension against casing 40 (meaning that the length of movement of the segment 20 in the second condition has been exhausted), the slip 10 has already moved down the cone, ramp or inclined plane and disengaged the wickers from the casing. Accordingly, there is far less resistance from tensile loading of the slip 10 than there would be for prior art slips.

Figure 5:
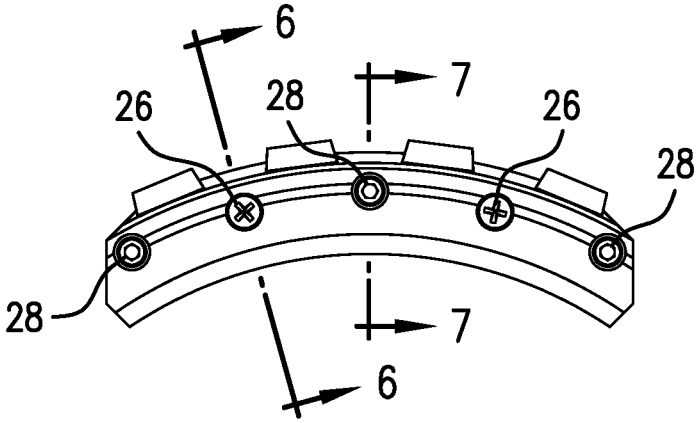
FIG. 5 is an end view of FIG. 1.
Figure 6:
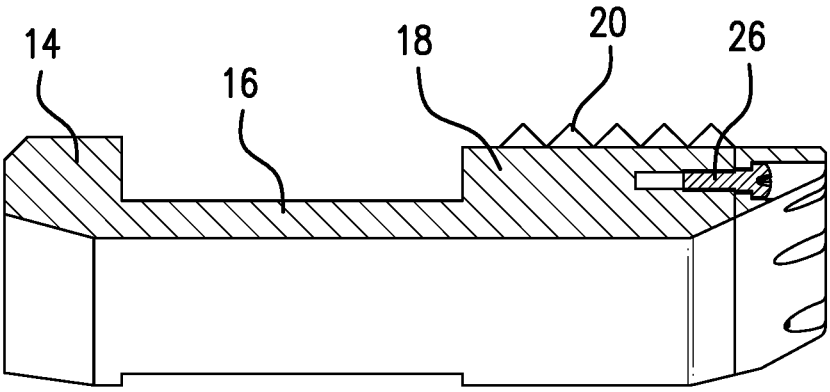
FIG. 6 is a cross-section view taken along section line 6-6 in FIG. 5.
Figure 7:
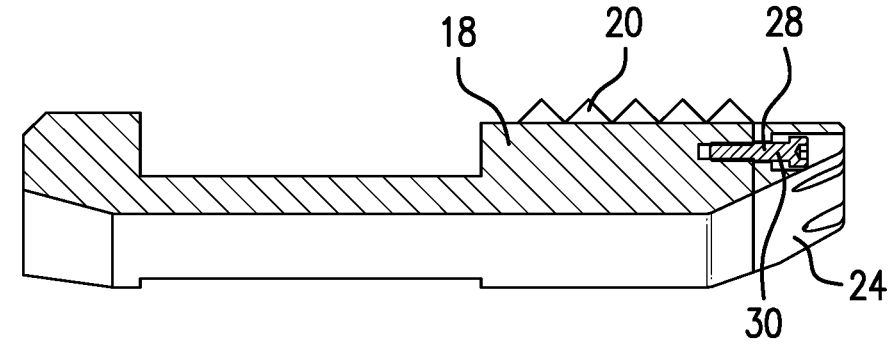
FIG. 7 is a cross-section view taken along section line 7-7 in FIG. 5.
Figure 7:
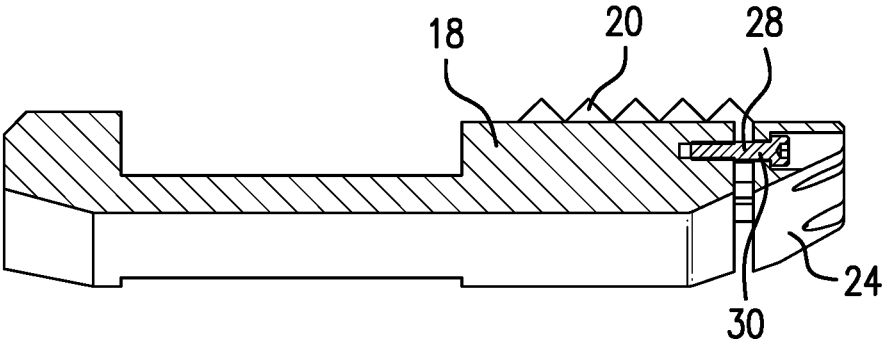

Enabling the actions discussed above are the cap 24 and the groove 22 in which the segment 20 resides. The cap 24 retains the segment 20 in an initial position in the groove 22 at all times prior to a retrieval operation. When retrieval is desired, the slip 10 is subjected to tensile loading thereby loading the segment against the casing and against the cap 24. Referring to FIGS. 5-7, it will be appreciated that in an embodiment, the cap 24 is initially secured near or against head 18 by a release member 26, such as a shear screw. Also, in some embodiments, the cap 24 may also be retained post release of the release member 26 by a retainer 28. In embodiments, retainer 28 may be a fastener that extends through a clearance hole 30 in the cap 24. If the retainer is not used, the cap can migrate in the borehole. Usually this would simply be to the bottom of the hole but sometimes could become a nuisance, hence the retainer.

In an embodiment the distance the segment 20 should be allowed to move in the second condition is in the range of 0.050 to 0.500 inch.

Figure 8:
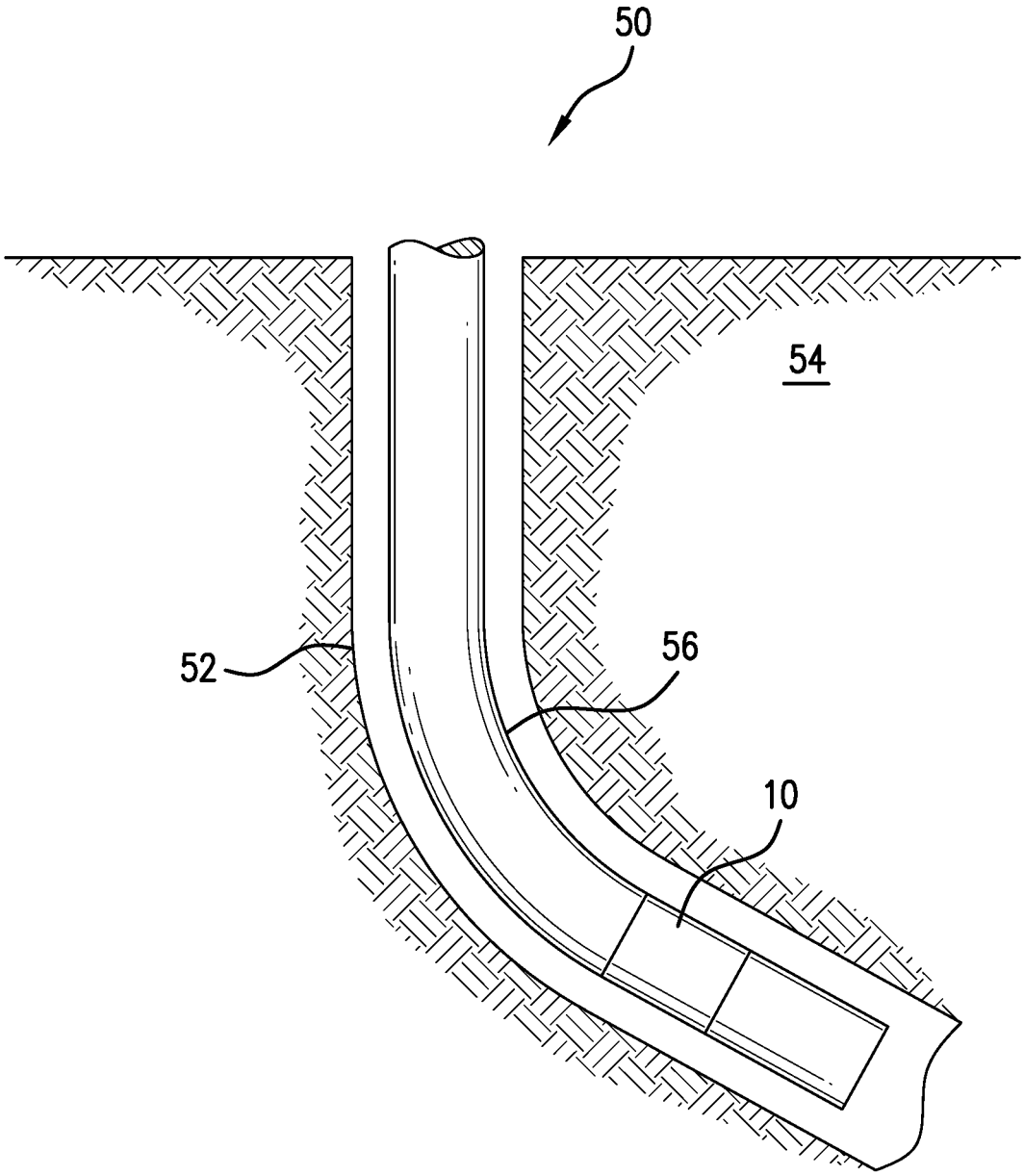
FIG. 8 is a view of a borehole system including the quick release slip as disclosed herein.

Referring to FIG. 8, a borehole system 50 is illustrated. The system comprises a borehole 52 in a subsurface formation 54. A string 56 is disposed within the borehole 52. A slip 10 is disposed within or as a part of the string 56.

Set forth below are some embodiments of the foregoing disclosure:

Embodiment 1: A slip including a slip body, the body including a slip tail, a slip mid-section connected to the tail, and a slip head connected to the mid-section, and a wicker segment receivable in a recess of the slip head, the segment having a first condition where the segment is immovable relative to the head and a second condition where the segment is movable relative to the head.

Embodiment 2: The slip as in any prior embodiment, further including a cap releasably attached to the slip head.

Embodiment 3: The slip as in any prior embodiment, wherein the cap retains the segment in the first condition prior to release.

Embodiment 4: The slip as in any prior embodiment, wherein the cap retains the segment in the second condition after release.

Embodiment 5: The slip as in any prior embodiment, wherein the recess is a dovetail.

Embodiment 6: The slip as in any prior embodiment, wherein the wicker segment is a plurality of wicker segments.

Embodiment 7: The slip as in any prior embodiment, wherein the recess is a plurality of recesses, each of the plurality of segments being receivable in one of the plurality of the recesses.

Embodiment 8: The slip as in any prior embodiment, further including a release member initially securing the cap to the slip head.

Embodiment 9: The slip as in any prior embodiment, wherein the release member is a shear screw.

Embodiment 10: The slip as in any prior embodiment, wherein the release member is a friction fit.

Embodiment 11: The slip as in any prior embodiment, further including a retainer retaining the cap to the slip head in a position facilitating the second condition of the segment.

Embodiment 12: The slip as in any prior embodiment, wherein the cap defines a clearance opening to pass part of the retainer.

Embodiment 13: A slip having a releasable wicker segment.

Embodiment 14: An anchor tool including a mandrel, a cone, ramp or inclined plane on the mandrel, a slip in operable contact with the cone, ramp or inclined plane, the slip having a wicker segment that is releasable from the slip.

Embodiment 15: The anchor tool as in any prior embodiment wherein the wicker segment is retained with a cap in a first condition of the segment.

Embodiment 16: The anchor tool as in any prior embodiment wherein the cap is retained in a spaced relationship from the slip in a second condition of the segment.

Embodiment 17: A method for retrieving a tool having slips, including loading the slip in tension, releasing a wicker segment of the slip, allowing the segment to move from a first condition to a second condition disengaging the segment from a radially outward structure.

Embodiment 18: The method as in any prior embodiment, wherein the releasing is by releasing a securement of a cap that secures the segment in the first condition.

Embodiment 19: The method as in any prior embodiment, further including retaining the cap in a position that allows the segment to move to the second condition.

Embodiment 20: A borehole system including a borehole in a subsurface formation, a string in the borehole, and a slip as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip, comprising:

a slip body, the body including:

a slip tail;

a slip mid-section connected to the tail;

a slip head connected to the mid-section;

a cap releasably attached longitudinally aligned with the slip body;

a wicker segment receivable in a recess of the slip head, the segment having a first condition where the segment is longitudinally trapped between the head and the cap and immovable relative to the head and a second condition where the segment is movable relative to the head upon release of the cap.

2. The slip as claimed in claim 1, wherein the cap retains the segment in the first condition prior to release.

3. The slip as claimed in claim 1, wherein the cap retains the segment in the second condition after release.

4. The slip as claimed in claim 1, wherein the recess is a dovetail.

5. The slip as claimed in claim 1, wherein the wicker segment is a plurality of wicker segments.

6. The slip as claimed in claim 5, wherein the recess is a plurality of recesses, each of the plurality of segments being receivable in one of the plurality of the recesses.

7. The slip as claimed in claim 1, further including a release member longitudinally oriented to the slip and initially securing the cap to the slip head.

8. The slip as claimed in claim 7, wherein the release member is a shear screw.

9. The slip as claimed in claim 7, wherein the release member is a friction fit.

10. A slip, comprising:

a slip body, the body including:

a slip tail;

a slip mid-section connected to the tail; and a slip head connected to the mid-section;

a wicker segment receivable in a recess of the slip head, the segment having a first condition where the segment is immovable relative to the head and a second condition where the segment is movable relative to the head;

a cap releasably attached to the slip head, the cap retaining the segment in the second condition after release; and further including a retainer retaining the cap to the slip head in a position facilitating the second condition of the segment.

11. The slip as claimed in claim 10, wherein the cap defines a clearance opening to pass part of the retainer.

12. A slip having a releasable wicker segment disposed between a slip head and a cap attached to and longitudinally aligned with the head, the wicker segment being movable relative to the head upon release of the cap from the head.

13. An anchor tool comprising:

a mandrel;

a cone, ramp or inclined plane on the mandrel;

a slip in operable contact with the cone, ramp or inclined plane, the slip having a receptacle for a wicker segment that is releasable from the slip;

a cap attached to and longitudinally aligned with the slip, the wicker segment being disposed between the slip and the cap, and movable relative to the slip upon release of the cap from the slip.

14. The anchor tool as claimed in claim 13 wherein the wicker segment is retained with aby the cap in a first condition of the segment.

15. The anchor tool as claimed in claim 14 wherein the cap is retained in a spaced relationship from the slip in a second condition of the segment.

16. A method for retrieving a tool having slips, comprising:

loading the slip as claimed in claim 1 in tension;

releasing a wicker segment of the slip;

allowing the segment to move from a first condition to a second condition disengaging the segment from a radially outward structure.

17. The method as claimed in claim 16, wherein the releasing is by releasing a securement of a cap that secures the segment in the first condition.

18. The method as claimed in claim 17, further including retaining the cap in a position that allows the segment to move to the second condition.

19. A borehole system comprising:

a borehole in a subsurface formation;

a string in the borehole; and a slip as claimed in claim 1 disposed within or as a part of the string.

* * * * *